US006309229B1

(12) United States Patent
Sinclair

(10) Patent No.: US 6,309,229 B1
(45) Date of Patent: Oct. 30, 2001

(54) ELECTRICAL TRACK AND ADAPTER ASSEMBLY

(75) Inventor: John Ashton Sinclair, Erina (AU)

(73) Assignee: Universal Power Track Pty. Ltd., New South Wales (AU)

( * ) Notice: Subject to any disclaimer, the term of this patent is extended or adjusted under 35 U.S.C. 154(b) by 0 days.

(21) Appl. No.: 09/254,577

(22) PCT Filed: Sep. 10, 1997

(86) PCT No.: PCT/AU97/00589

§ 371 Date: Apr. 27, 1999

§ 102(e) Date: Apr. 27, 1999

(87) PCT Pub. No.: WO98/11634

PCT Pub. Date: Mar. 19, 1998

(30) Foreign Application Priority Data

Sep. 10, 1996 (AU) ..... PO2229

(51) Int. Cl.[7] ..... H01R 25/00

(52) U.S. Cl. ..... 439/110; 439/121; 439/439; 439/122

(58) Field of Search ..... 439/110, 117, 439/94, 121, 122, 136, 145

(56) References Cited

U.S. PATENT DOCUMENTS

| | | | | |
|---|---|---|---|---|
| 2,240,180 | | 4/1941 | Frank | 173/334.1 |
| 4,040,713 | * | 8/1977 | Konnemann | 439/839 |
| 4,405,193 | | 9/1983 | Weidler . | |
| 4,553,808 | * | 11/1985 | Weidler et al. | 439/391 |
| 5,399,094 | | 3/1995 | Korth | 439/110 |
| 5,839,909 | * | 11/1998 | Calderara et al. | 439/137 |

FOREIGN PATENT DOCUMENTS

| | | | |
|---|---|---|---|
| 3644995 | 4/1966 | (AU) . | |
| 4689872 | 3/1974 | (AU) . | |
| 70863 | 7/1974 | (AU) . | |
| 9150182 | 6/1983 | (AU) . | |
| 4055085 | 10/1985 | (AU) . | |
| 2421592 | 3/1993 | (AU) . | |
| 3030449 | 3/1982 | (DE) . | |
| 1508788 | 4/1978 | (GB) . | |
| 1591415 | 9/1981 | (GB) . | |
| 207995 | 3/1988 | (NZ) . | |
| 9319506 | 9/1993 | (WO) . | |
| WO 96/12327 * | 4/1996 | (WO) | H01R/25/14 |

* cited by examiner

*Primary Examiner*—Tulsidas Patel
*Assistant Examiner*—Chandrika Prasad
(74) *Attorney, Agent, or Firm*—Ladas & Parry

(57) ABSTRACT

An electrical supply assembly (10) which includes an elongated base (11) which receives longitudinally extending conductors (29). The conductors (29) are formed by a plurality of "U" shaped ribs joined by longitudinally extending strips (37). An adaptor (40) is mounted on the assembly (10) and is provided with pins (22, 23 and 24) to engage the conductors (29). The adaptor (40) has a base (45) within which there are located sockets (57) to be engaged by the pins of an electric plug. The sockets (57) are attached to the pins (22, 23 and 24). The base (45) is rotatable so as to move the pins (22, 23 and 24) into contact with the conductors (29). A shutter member (47) is located within the base (45) to selectively provide access to the sockets (57).

3 Claims, 12 Drawing Sheets

ELECTRICAL TRACK AND ADAPTER ASSEMBLY

TECHNICAL FIELD

The present invention relates to electricity supply apparatus and in particular to a track assembly to be used in conjunction with a plug to provide an electricity supply at the plug.

BACKGROUND OF THE INVENTION

Described in International Application PCT/AU95/00675 is a flexible ducting system. The duct system described in the following specification is a modification of this earlier ducting system.

The present inventions are also an improvement in the invention which is the subject of Australian Patent 655069. The track electric supply system described in this earlier patent has several shortcomings. In particular the conductor has difficulty maintaining contact with the plug and access to the conductors is not inhibited and therefore accidental contact may occur with the positive and neutral conductors.

New Zealand Patent 207995 discloses an electrical distribution system. The system includes a rigid track which receives insulating material within which there is located conductors to be engaged by a plug. The conductors are of a "U" transverse cross section with longitudinally spaced extremities which are to engage pins of the plug. The extremities are spaced as are the similar extremities of the conductors discussed the above mentioned PCT application.

International Patent Publication WO 93/19506 (International Application PCT/NO93/00044) describes a rail electrical system. The rail has a plurality of slots, with each slot receiving an elongated conductor. The engaged conductors is a plug which is rotatable between an engaged and a non-engaged position. The conductors are merely elongated metal strips which are not connected.

The conductor of Australian Patent Application 70863/74 is of a similar construction in that the conductors are merely metal strips not connected.

The conductor of German Specification 3030449 A1 describes a rail type electrical supply system, with the conductor being a metal wire of circular transverse cross section.

U.S. Pat. No. 5,399,094 discloses a device for digital data transmission. The device employs a strip like metal contact.

UK Patent 1597415 discloses a rail type electrical supply system in which the conductors are longitudinally extending strips, with the strips not being connected.

Australian Patent Application 91501/82 describes a rail type electric supply system in which the conductors are of a "U" configuration in transverse cross section throughout the length.

U.S. Pat. No. 2,240,180 again shows a rail electric supply system in which the conductors are of a "U" configuration with the arms of the conductor being spaced.

UK Patent 1508788 also shows a rail electric supply system with the contact being space metal strips which are not joined.

The above mentioned electric supply system suffers from the disadvantage that they do not provide for good contact between the conductor and any plugs or contacts employed.

OBJECT OF THE INVENTION

It is the object of the present invention to overcome or substantially ameliorate the above disadvantages.

SUMMARY OF THE INVENTION

There is disclosed herein an elongated flexible electric conductor of unitary construction, said conductor comprising:

- a pair of generally parallel coextensive electrically conductive strips; and
- a resilient support urging the strips into contact, said support being resiliently deformable upon transverse relative displacement of the strips when an item to electrically contact the strips is placed therebetween, said support including a plurality of generally "U" shaped ribs providing arms, said ribs extending generally transverse of the strips so that each rib has a respective one of its arms attached to an associated one of the strips.

There is further disclosed herein an electric supply assembly an electrical supply assembly, said assembly comprising:

- an elongated base providing a plurality of generally parallel coextensive slots separated by generally rigid dividing walls, the slots extending from an access passage;
- a flexible insulator extending along each slot;
- an elongated conductor located in each insulator; and wherein
- said access passages enables insertion of a conductive pin In a respective one of the slots for engagement with the conductor located therein.

There is still further disclosed herein an electrical adaptor an electrical adaptor for use with an electric supply assembly having an elongated base within which there is located a plurality of elongated conductors to be engaged by the adaptor, said adaptor comprising:

- a mounting to engage the assembly so as to be affixed thereto;
- an engaging portion with a stem having radially extending pins to enter the assembly to engage the conductors, the engaging portion being pivotable relative to said base about a longitudinal axis of the stem between a first position at which the conductors are engaged by the pins, and a second position allowing removal of the engaging portion from within the assembly, said engaging portion also having sockets to engage pins of an electric plug;
- a base fixed to said engaging portion so as to move therewith, said base generally enclosing said sockets and having apertures aligned with said sockets to provide or access of the electric plug pins to said sockets; and
- shutter means to close said apertures when said engaging portion is in said second position but allow access to said sockets when said engaging portion is in said first position.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
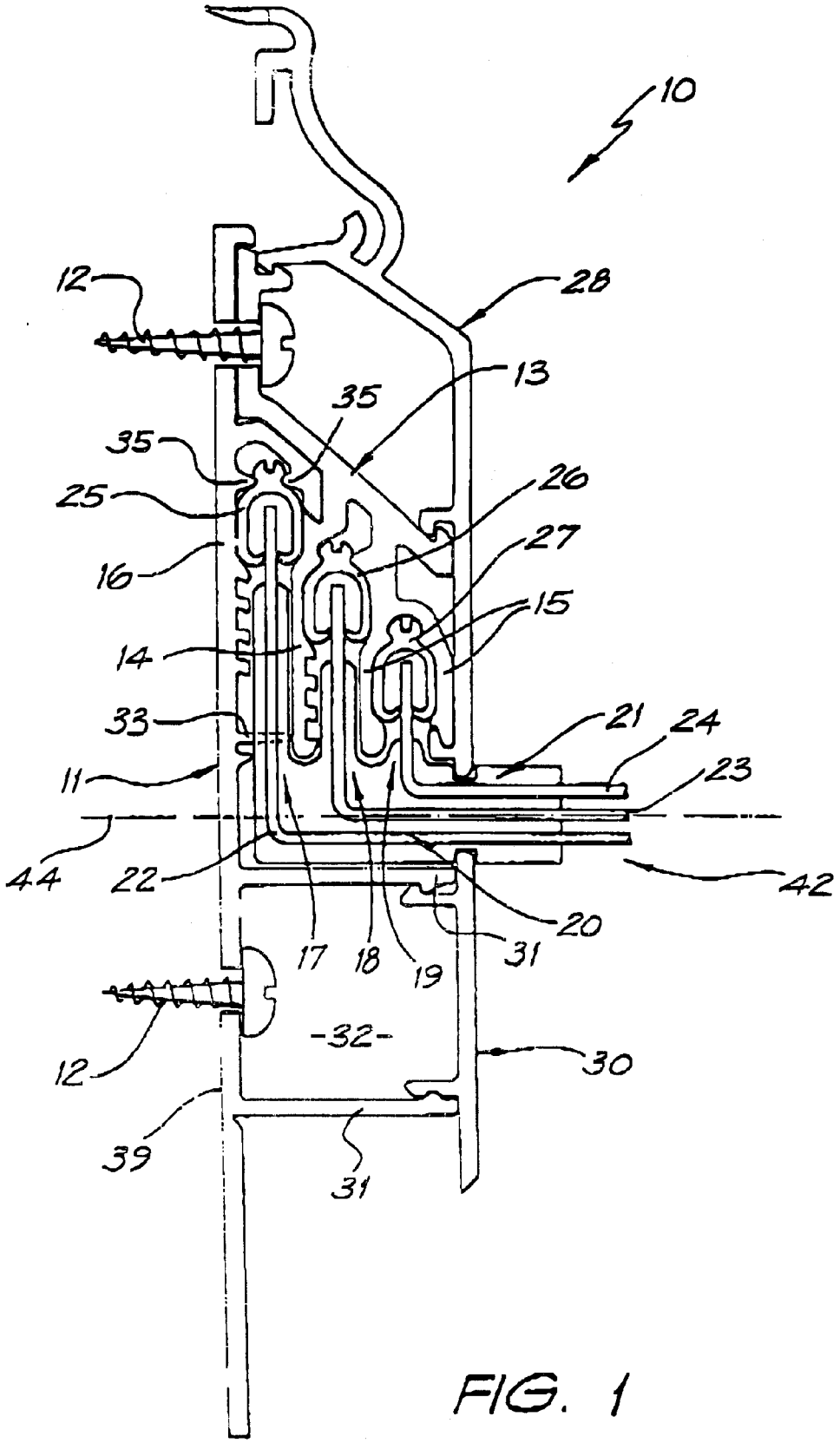
FIG. 1 is a schematic end elevation of an electrical supply assembly.
Figure 2:
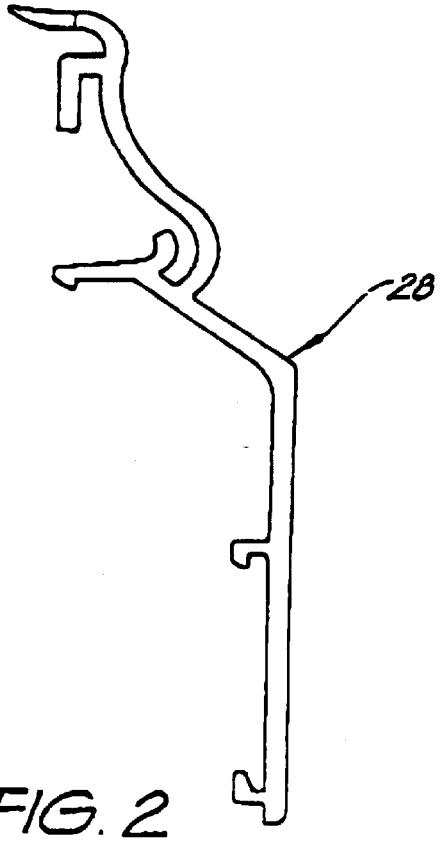
FIGS. 2 to 6 are schematic end elevations of portions of the assembly of FIG. 1.
Figure 3:
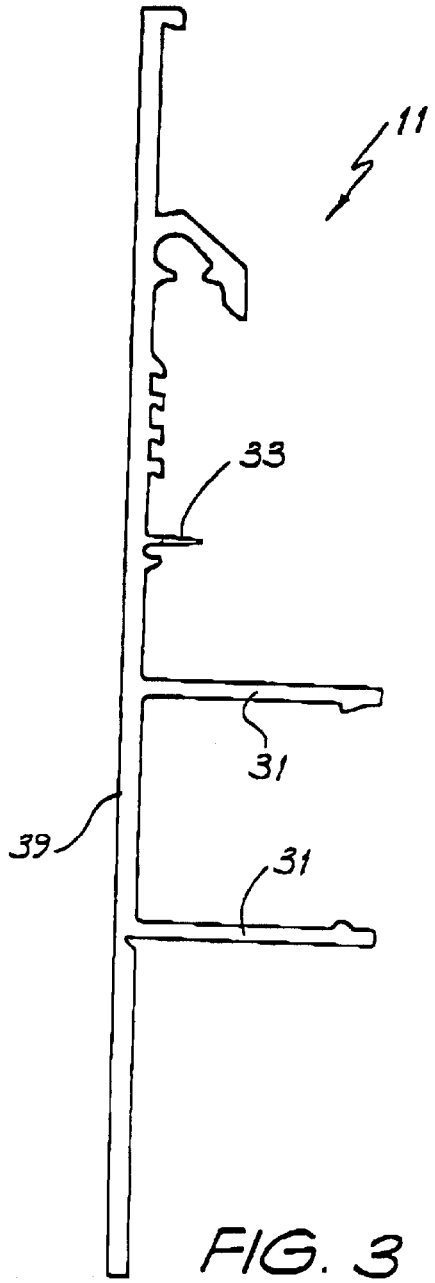
Figure 4:
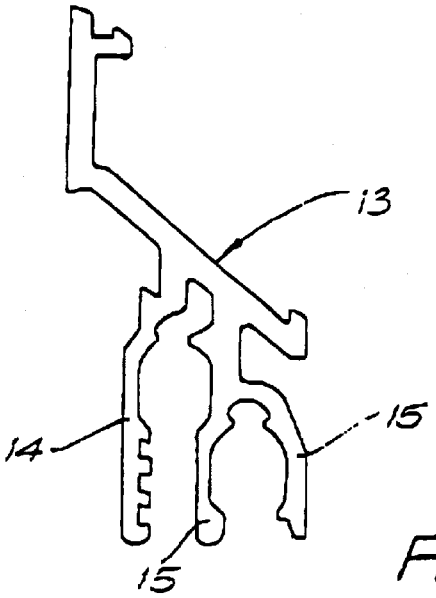
Figure 5:
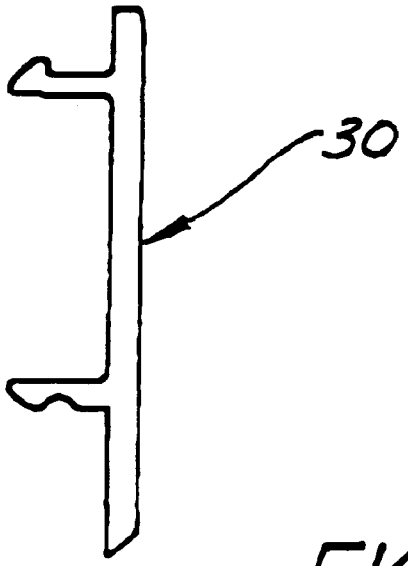
Figure 6:
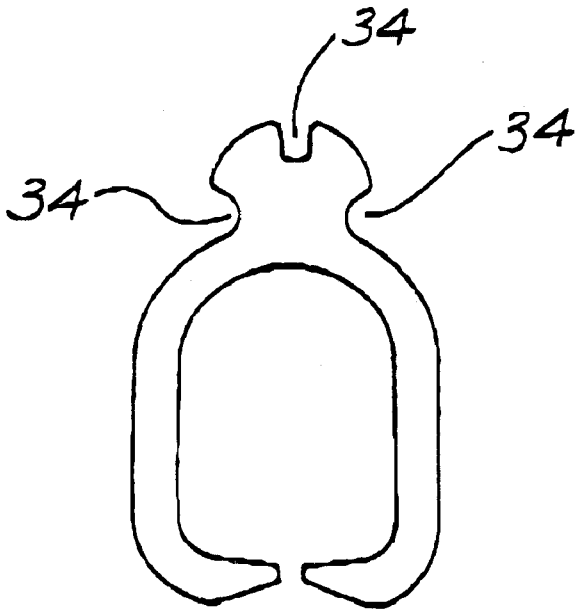

In the accompanying drawings there is schematically depicted an electrical supply assembly 10 which for example may also be used as a skirting board in a building. The assembly 10 includes a base 11 which is intended to be fixed to a supporting wall by means of threaded fasteners 12. The base 11 includes a longitudinally extending divider member 13 providing rigid walls 14 and 15 which cooperate with the end wall 16 to define and separate three generally parallel coextensive slots 17, 18 and 19. The slots 17, 18 and 19 are open to a horizontal access passage 20. The slots 17, 18 and 19 open into the passage 20, which passage 20 extends to a longitudinally extending access slot 21 which enables "L" shaped pins 22, 23 and 24 to extend through the passage 20 and into engagement with longitudinally extending flexible conductors 29 located within flexible insulators 25, 26 and 27. The pins 22, 23 and 24 are generally flat in configuration so as to have generally planar side surfaces which engage conductors 29.

Figure 7:
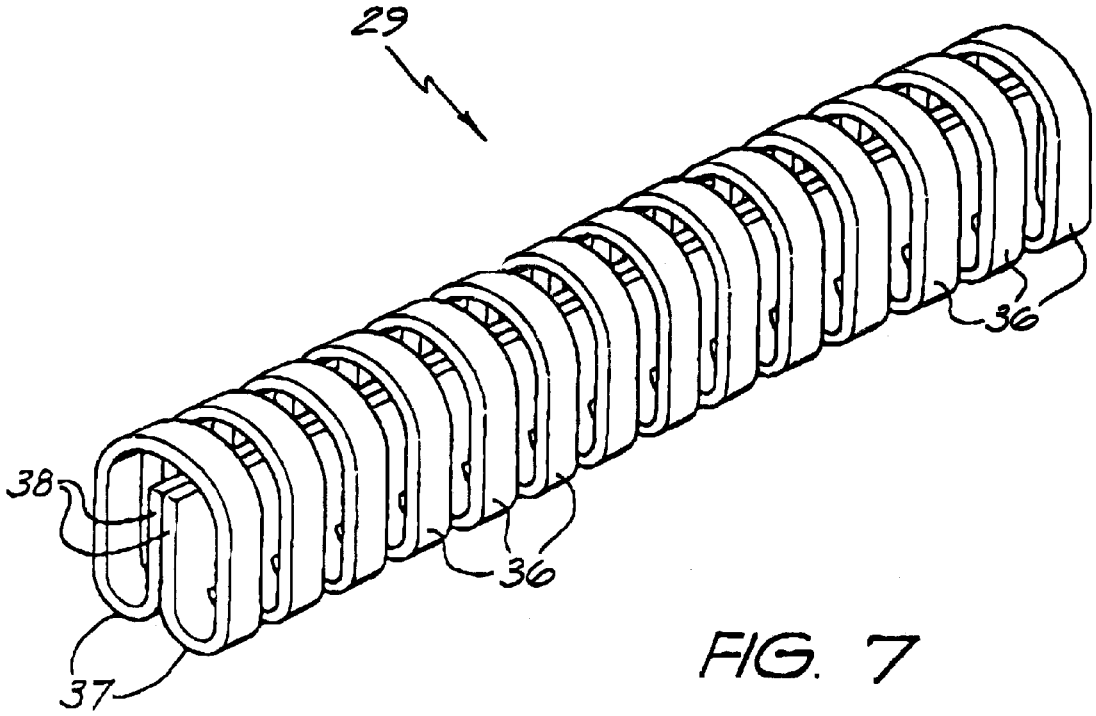
FIG. 7 is a schematic perspective view of a flexible conductor employed in the assembly of FIG. 1.
Figure 8:
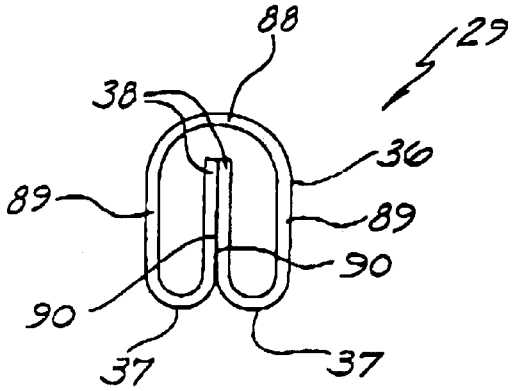
FIG. 8 is a schematic end elevation of the conductor of FIG. 7.

The insulators 25, 26, and 27 are spaced from the passage 20. Typically the electric conductor 29 is as illustrated in FIGS. 7 and 8. The slots 17, 18 and 19 extend upwardly from the passage 20. The base 11 further includes a cover member 28 which snap engages on the divider member 13. A further cover member 30 is provided which snap engages on walls 31 extending from the base back portion 39. The cover member 30 and walls 31 cooperate to provide a longitudinally extending cavity 32 which can receive cabling or other items.

The rigid walls 14 and 15 provide for secure separation of the conductors 29, thereby preventing incorrect contact with the pins 22, 23 and 24. The walls 14 and 15 also inhibit other objects being inserted and contacting the active conductor 29.

Preferably at least one or all of the slots 17, 18 and 19 is/are closed by a flexible longitudinally extending flange 33, which is resiliently deflected from a closing position to a position providing access to the flexible conductor 29 enclosed within the associated insulator 25, 26 or 27.

Each of the insulators 25, 26 and 27 is provided with longitudinally extending recesses 34 which engage with correspondingly extending ridges 35 on the base 11, to aid in retaining the insulators 25, 26 and 27 in a position within their respective slots 17, 18 and 19.

Each conductor 29 includes a plurality of ribs 36 which are of a "U" configuration extending via arcuate portions 37 to a pair of generally parallel coextensive strips 38. The strips 38 have abutting generally planar contact surfaces 90. The conductor 29 is manufactured from suitable conductive material (such as copper or bronze) and is flexible so that it may be bent about a transverse axis located generally within the plane of the strips 38 but normal to the longitudinal direction of extension of the conductor 29 (a vertical axis). The conductor 29 is formed of material which is sufficiently resilient that one of the pins 22, 23 or 24 can pass between the surfaces 90 of the strips 38, but bias the strips 38 into contact with the pin. This ensures a good electrical connection. At rest the strips 38 are in contact. When in contact with the pins 22, 23 and 24 the surfaces 90 are generally parallel.

In FIGS. 18 to 21 of the accompanying drawings there is schematically depicted a modification of the above discussed divider member 13. In this modification a divider member 70 is provided which is an assembly of a divider base 71 having rigid is walls 72, 73 and 74 which cooperate to provide the coextensive slots 18 and 19 as described in the previous embodiment. However, the base 70 also provides a longitudinally extending barb 75 to which is attached a slot forming insulating member 76. The slot forming member 76 has a pair of longitudinally extending barbs 77 which cooperate to snap engage with the barb 75. The member 76 would provide the longitudinally extending slot 17 described in the previous embodiment.

Figure 19:
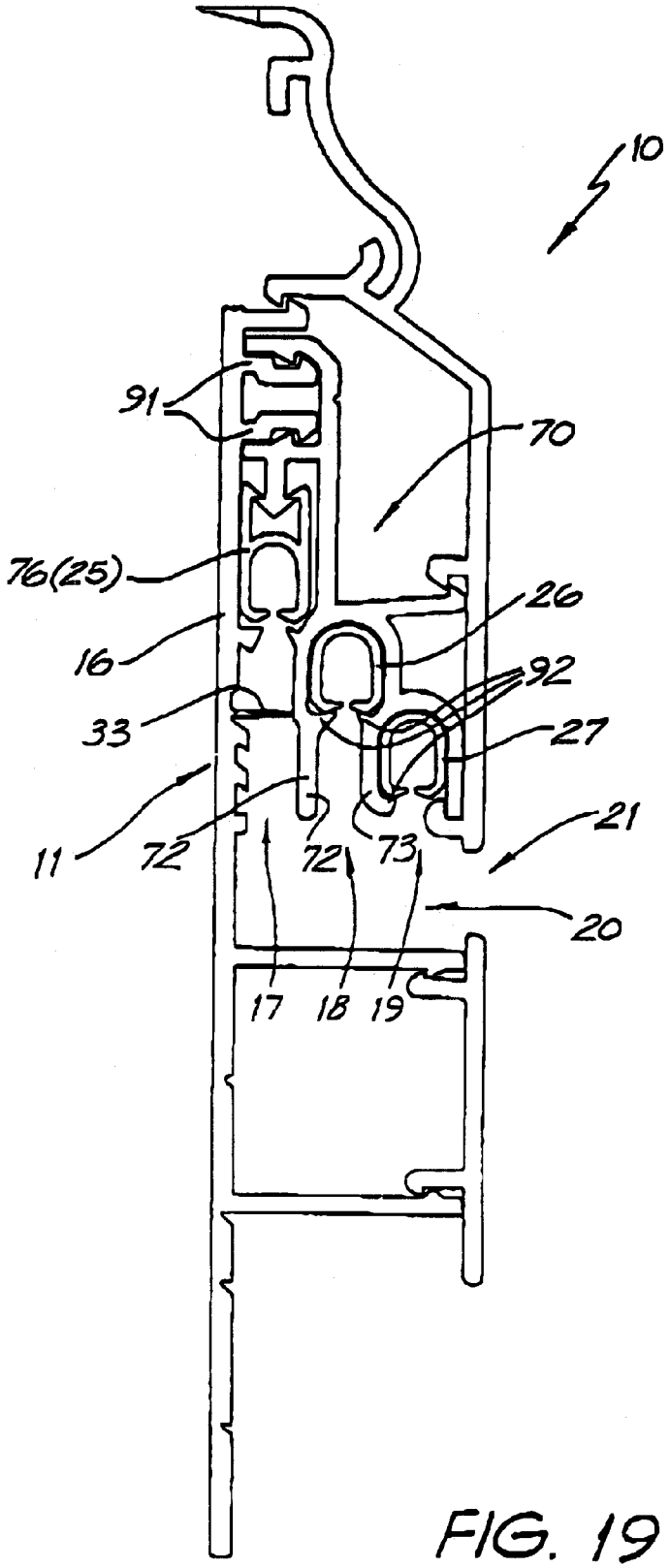
FIG. 19 is a schematic end elevation of a modification of the supply assembly of FIG. 1.
Figure 21:
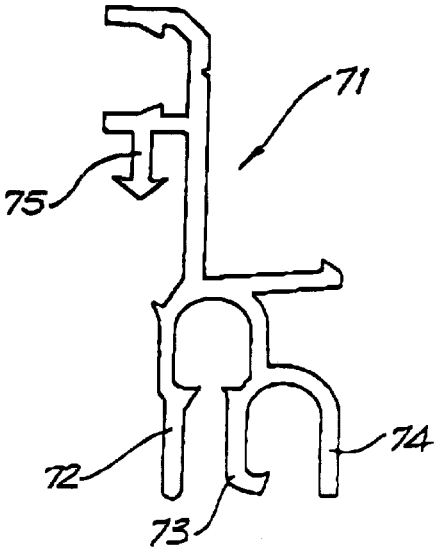
FIG. 21 is a further schematic end elevation of the divider member of FIG. 20.
Figure 20:
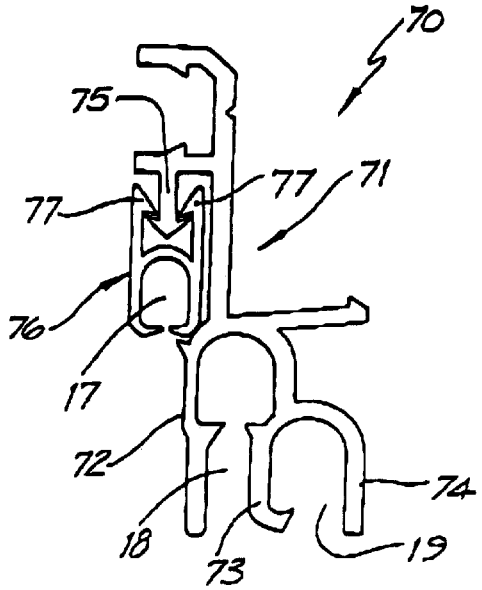
FIG. 20 is a schematic end elevation of a divider member employed in the assembly of FIG. 19.
Figure 22:
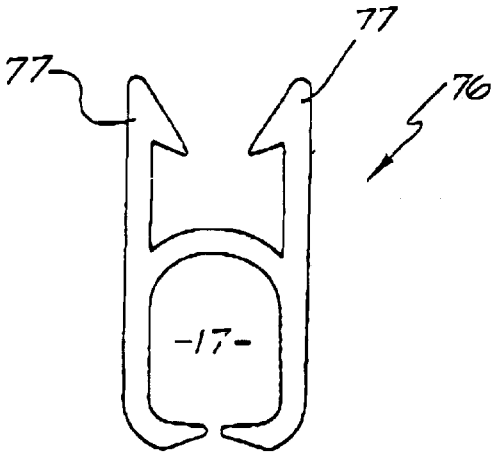
FIG. 22 is a schematic end elevation of an insulating member employed in the assembly of FIG. 19.

The assembly 10 of FIG. 19 includes the basic construction of the assembly 10 of FIG. 1. However, in this embodiment the wall 16 has a pair of projections 91 which snap engage the divider member 70 to secure the divider member 70 to the wall 16.

The walls 72 and 73 are provided with barbs 92 to aid in retaining the insulators 76 (25), 26 and 27 in position. Each of the insulators is of a "U" configuration so it has to have an arcuate top from which there extends a pair of legs terminating with resilient flanges at their extremities. When a pin enters any one of the insulators, the flanges are deflected enabling contact of the pin with the conductor 29 so located therein.

Again the rigid walls 72, 73 and 74 prevent incorrect engagement of the pins 22, 23 and 24 with a conductor located between the walls 72, 73 and 74.

The member 76 would also be formed of flexible insulating material and therefore would be equivalent to the insulator 25 of the previous embodiment. The slots 18 and 19 would receive insulators 26 and 27 of the previous embodiment. Again the insulators 25, 26 and 27 would each receive a conductor 29.

The conductor 29 is of a unitary construction and as discussed above is flexible so that it may be bent about a vertical axis generally transverse of the conductor 29. The conductor 29 may also be bent about a horizontal axis transverse of the conductor 29. As best seen in FIGS. 7 and 8 the conductor 29 has a pair of parallel generally coextensive strips 38 which engage the pins 22, 23 and 24. When not engaged with the pins 22, 23 and 24, the strips 38 am in contact. However, again as discussed above, upon one of the pins 22, 23 or 24 being inserted between a pair of the strips 38, the strips 38 part but are urged into contact with the associated pins 22, 23 or 24 due to the resilience of the conductor 29, and more particularly the resilience of the ribs 36. By urging the strips 38 into contact with de pins 22, 23 and 24, electrical contact is enhanced.

Again, as best seen in FIGS. 7 and 8, the conductor 29 includes a plurality of spaced ribs 36, with each rib including a base 88 which is of arcuate configuration and joined to a pair of arms 89 which are generally parallel and coextensive. The arms 89 extend to the arcuate portions 37 which in turn extend to the strips 38. The strips 38 are located between the arms 89.

When one of the pins 22, 23 or 24 is located between an associated pair of the strips 38, adjacent portions of the strips 38 are deflected relatively to each other transversely of the conductor 29.

In this embodiment the pin 22 would be the active connection, the pin 23 the neutral connection and the pin 24 the earth connection, In FIGS. 9 to 14 there is schematically depicted an adaptor 40 to be used in conjunction with the assembly 10 The adaptor 40 engages the conductors 29 and provides a socket, which for example can receive the pins of a conventional electric plug.

Adapted to engage the assembly 10 is a mounting plate 41. The plate 41 has a flange 42 which projects into the slot 21. The adaptor 40 has a stem 43 from which the pins 22, 23 and 24 generally radially extend. The stem 43 is inserted through the slot 21 to enter the passage 20. When the stem 43 is fully inserted it is rotated about the axis 44 until the pins 22, 23 and 24 engage the conductors 29. The earth pin 24 engages first, and is also last to disengage.

Figure 9:
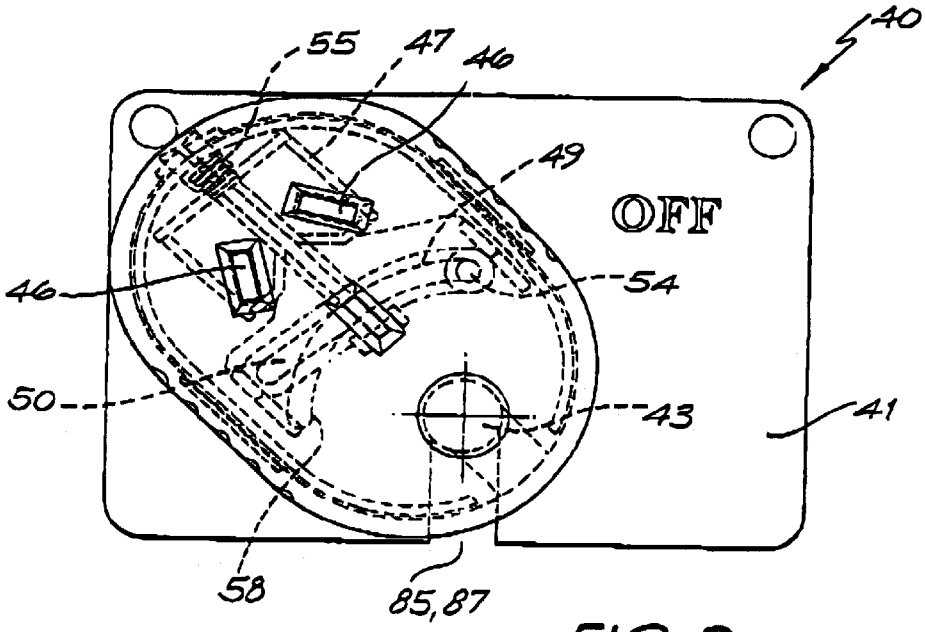
FIG. 9 is a schematic front elevation of an adaptor to be used with the assembly of FIG. 1.
Figure 10:
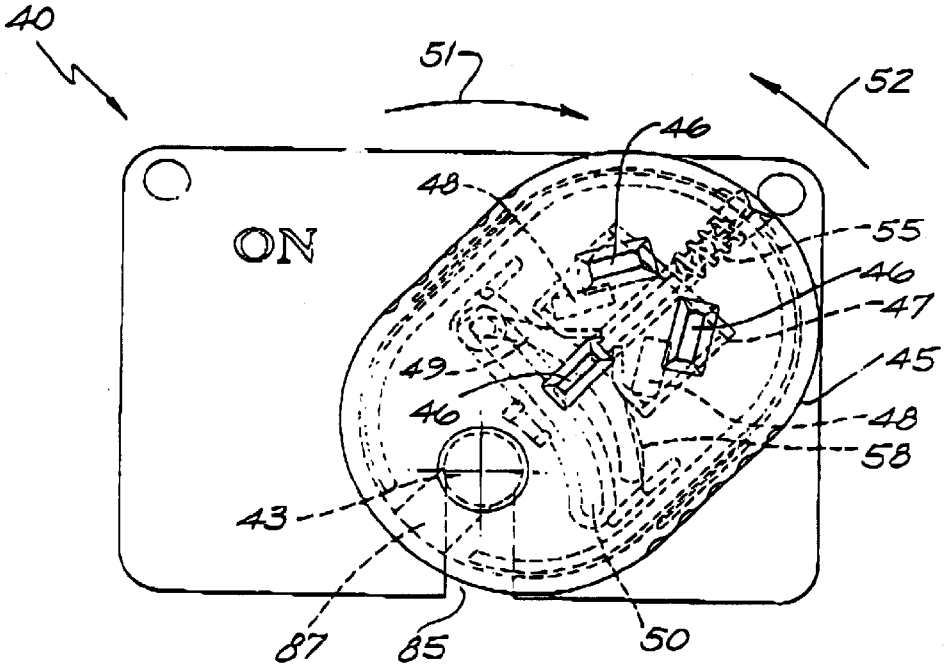
FIG. 10 is a schematic front elevation of the adaptor of FIG. 9 in a second operative position.
Figure 11:
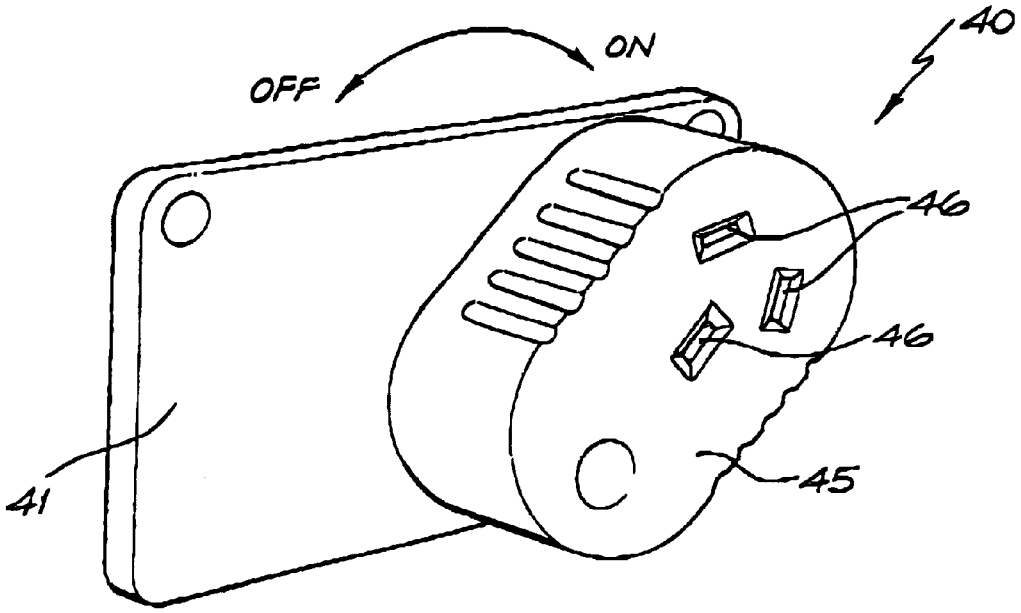
FIG. 11 is a schematic perspective view of the adaptor of FIG. 9.
Figure 12:
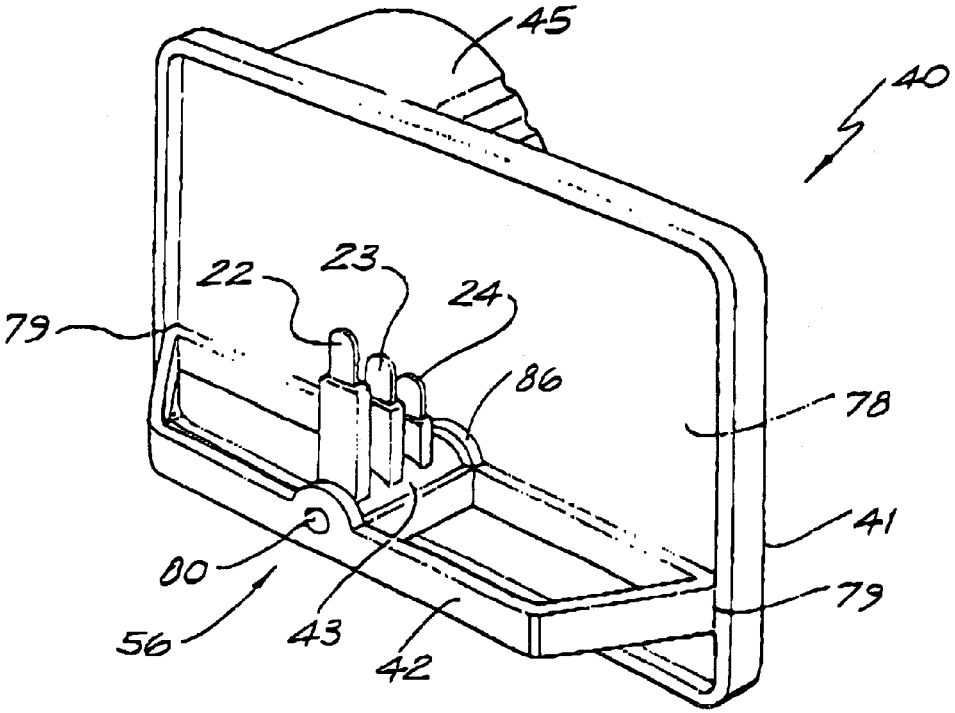
FIG. 12 is a schematic rear perspective view of the adaptor as seen in FIG. 11.
Figure 13:
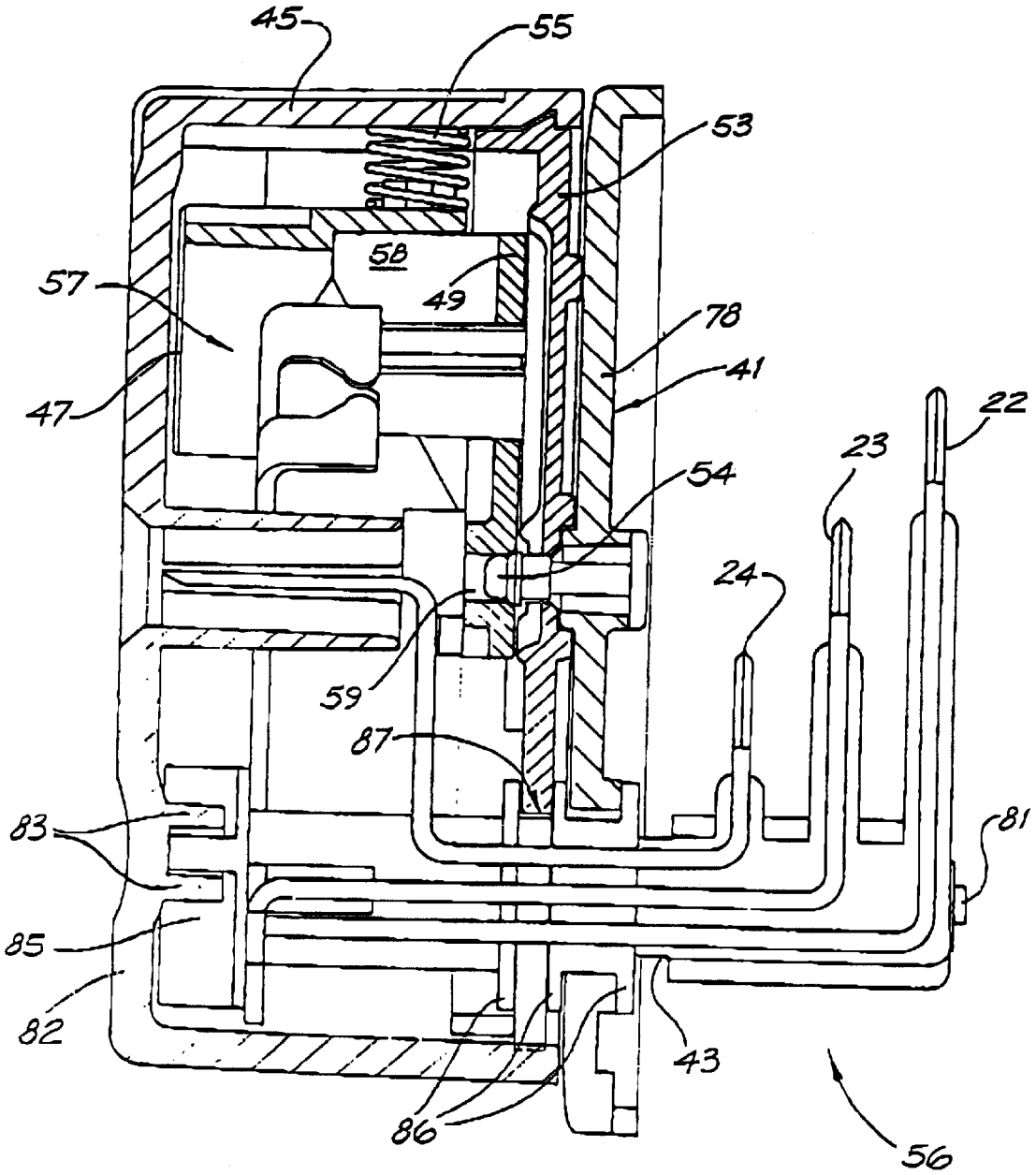
FIG. 13 is a schematic section side elevation of the adaptor of FIG. 9.

The adaptor 40 includes a base 45 which has a rear plate 53 and apertures 46 which are conventionally positioned to receive the pins of a conventional plug. Movably mounted in guides is a shutter member 47 which in urn has apertures 48. The shutter member 47 is movable between a position at which it effectively closes the apertures 46 and a position at which each of the apertures 46 has aligned with it one of the apertures 48 so that the pins of a plug may be inserted in the adaptor 40 (FIG. 9). The member 47 is associated with cam member 49 having a cam slot 50 which engages the pin 54 fixed the plate 41. Angular relative movement between the pin 54 and member 49 about the axis 44 causes movement of the cam member 49. More particularly, the member 47 has an abutment 58 which engages the shutter member 47 to move the shutter member 47 to a position at which the apertures 46 are aligned with the apertures 48, when the cam member 49 moves in the direction of the arrow 51 relative to the pin 54. When the cam member 49 moves in the reverse direction 52 relative to the pin 54, the shutter member 47 is permitted to move to a position effectively closing the slots 46 by moving the slots 48 from alignment with the slots 46. However, this movement will only take place upon withdrawal of the plug pins which would retain the shutter member 47 in the "aligned" position. However, there is a spring 55 which urges the shutter member 47 to move to the "non-aligned" position FIG. 10). Accordingly, when the plug is removed the shutter member 47 will move to close the slots 46. It should be appreciated that the pin 54 also projects through an arcuate slot 59 formed in the rear plow 59. The slot 59 has its radius extending from the axis 44. The slot 59 permits relative movement between the pin 54 and plate 58 about the axis 44.

The adaptor 40 further includes a conductor engaging portion 56 which includes the stem 43. The base 45 and the conductor engaging portion 56 are attached as to rotate together about the axis 44 relative to the plate 41.

In use of the above described adaptor 40, the stem 43 is inserted as discussed above to engage the conductors 29. Accordingly, a user of the adaptor 40 inserts the electric plug before rotation of the base 45. Movement of the base 45 in the reverse direction 52 removes the pins 22, 23 and 24 from engagement with the conductors 29. When the electric plug is removed, the shutter member 47 covers the apertures 46.

The pins 22 to 24 extend through the stem 43 and radiate therefrom to sockets 57 internal of the adaptor 40, which sockets 57 are aligned with the apertures 46. Access to these sockets 57 is only permitted when the apertures 48 are aligned with the apertures 46.

The flange 42 of the above mentioned plate 41 could be formed separate from the plate body 78 and snap engage therewith at locations 79. The flange 42 would have an aperture 80 to receive a projection 81 at the end of the stem 43 to aid in supporting the engaging portion 56. The base 45, which is in the form of a "CAP", has an outer wall 82 provided with flanges 83, which intersect to provide a "X" shaped slot 84. The slot 84 receives a correspondingly shaped portion 85 of the stem 43 to aid in fixing the stem 43 to the base 45 so as to rotate therewith, The body 78 has a slot 85 which enables insertion of the engaging portion 56, with the stem 43 being provided with parallel flanges 86 Which engage th rear plate 53 and body 78. Similarly, the rear plate 53 has a slot 87 through which the stem passes.

In FIGS. 14 to 17 there is schematically depicted a modification of the adaptor 40 of FIGS. 9 to 12. In this embodiment the same reference numerals have been employed. However in this embodiment there is farther include a disk 60 to which is attached a spring 61. The spring 61 is attached to the mounting plate 41. The disk 60 is attached to or forms part of the stem 43. The spring 61 is attached to the disk 60 at a position such that the stem 43 (and pins 22, 23, and 24) are urged into full contact with the conductors 29 or alternatively to a position at which are displaced from the conductors 29. Accordingly the base 45 is urged to move to the fill on position or the full off position.

Figure 14:
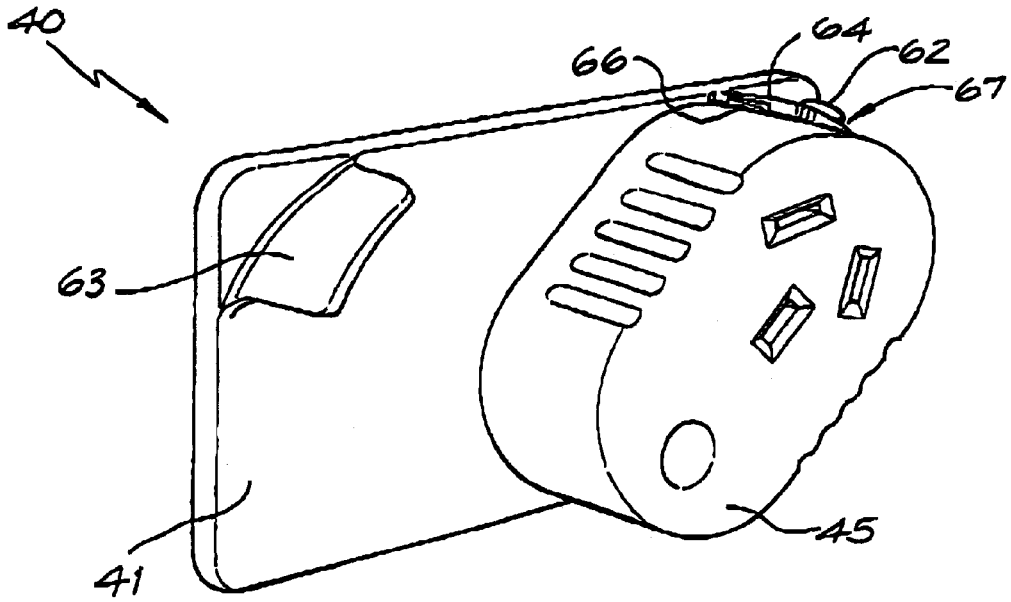
FIG. 14 is an schematic perspective view of modification of the adaptor of FIG. 9.
Figure 15:
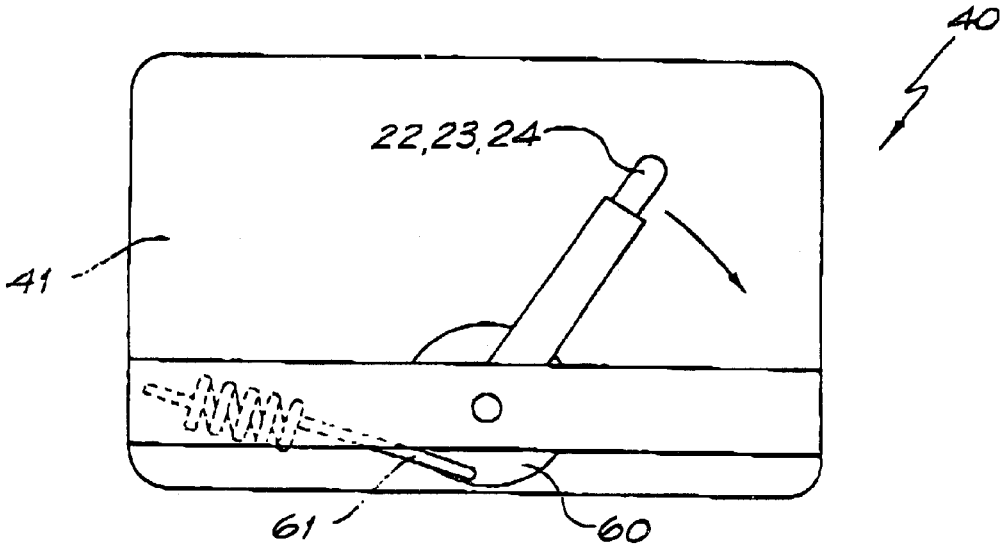
FIG. 15 is a schematic rear elevation of the adaptor of FIG. 14.
Figure 16:
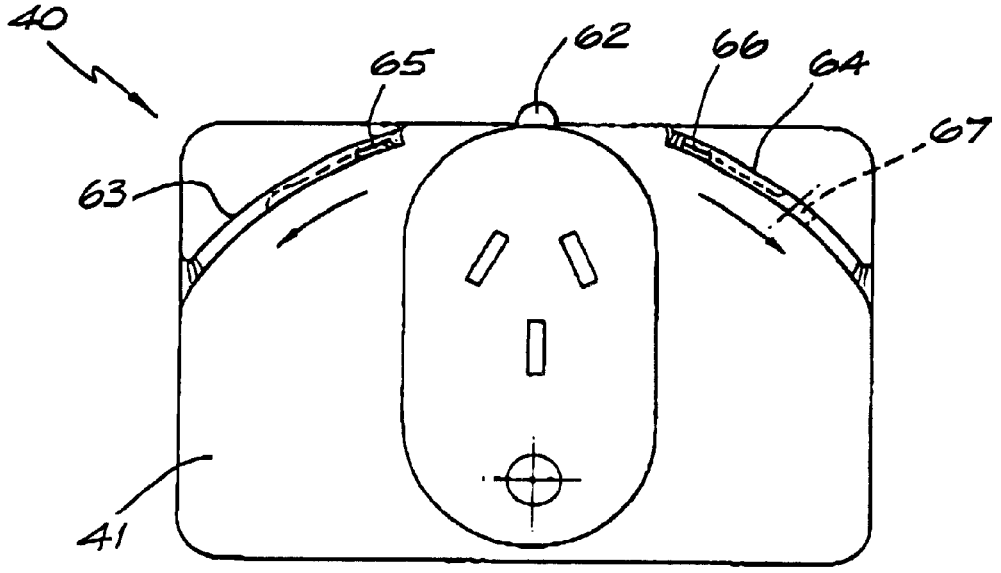
FIG. 16 is a schematic front elevation of the adaptor of FIG. 14.
Figure 17:
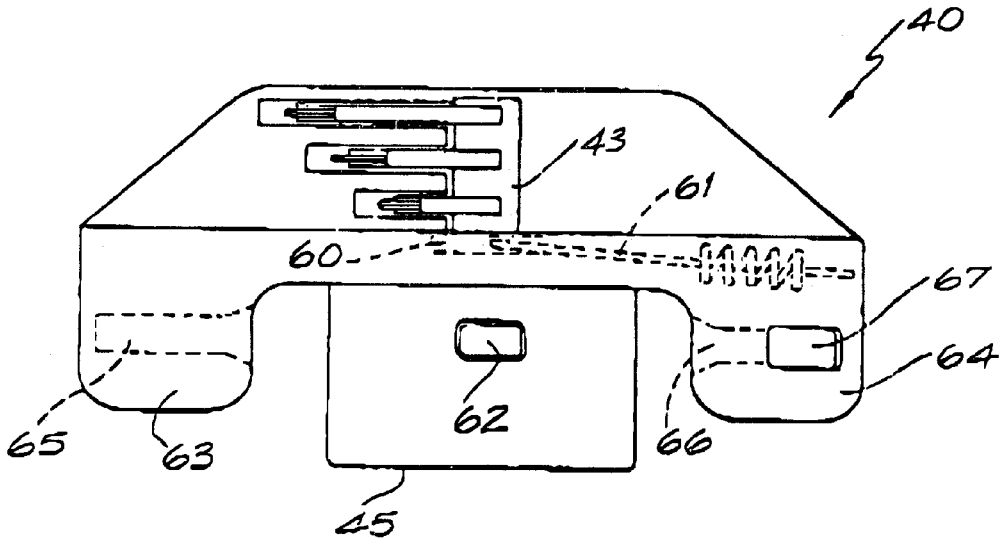
FIG. 17 is a schematic top plant view of the adaptor of FIG. 14.
Figure 18:
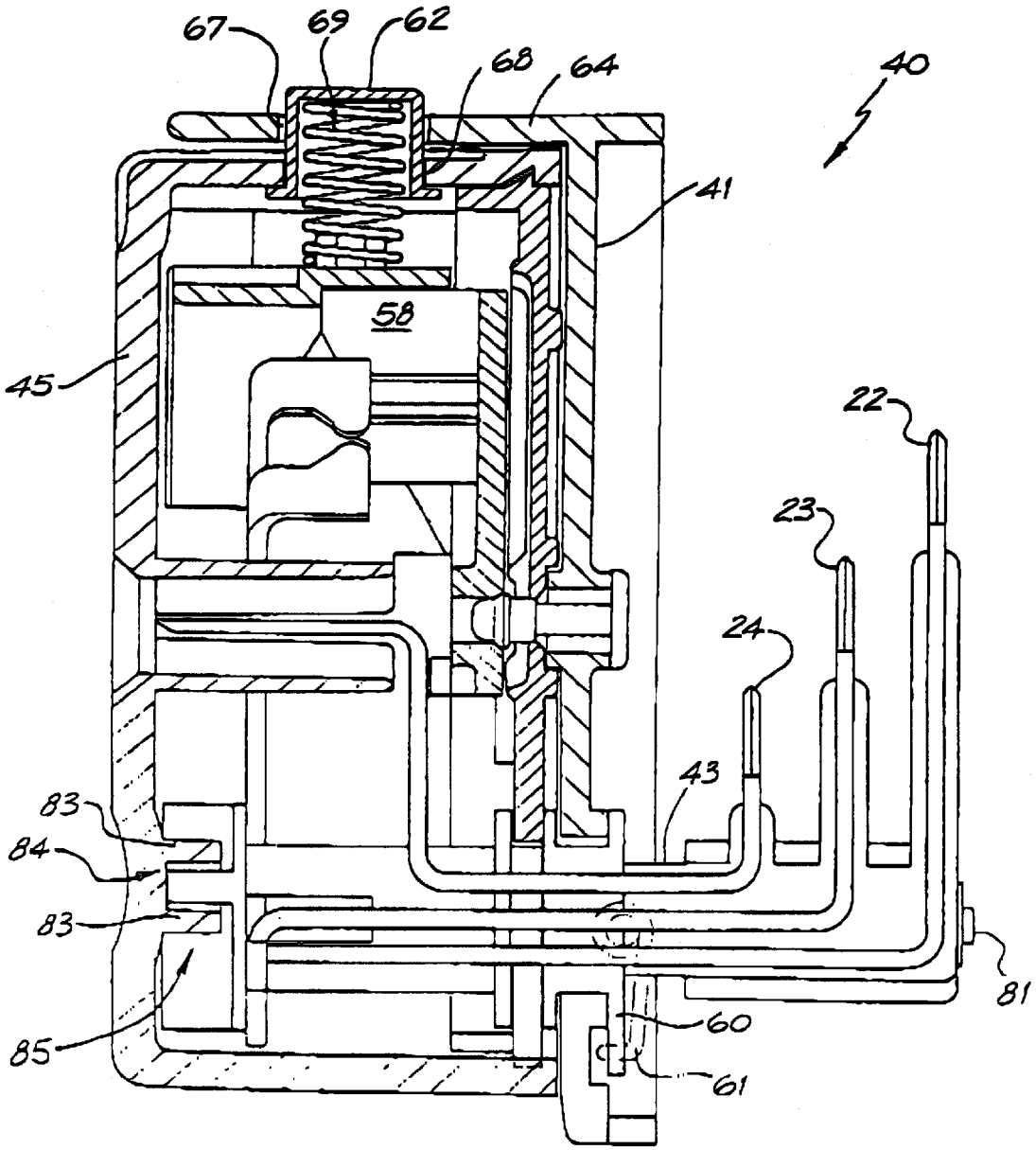
FIG. 18 is a schematic part sectioned side elevation of the adaptor of FIG. 14.

Also mounted on the base 45 is a button 62 which is engageable with flanges 63 and 64 forming part of the plate 41. The flange 63 has a slot 65 along which the button 62 passes while the flange 64 has a slot 66 also along which the button 62 passes. However the flange 64 has an aperture 67 positioned to the button 62, as best seen in FIG. 14. Engagement of the button 62 in the aperture 67 retains the housing 45 in the on position.

The button 62 is movably mounted in the base 45 by passing through an aperture 68 formed therein. The button 62 is urged to move radially outwardly by means of a spring. This spring replaces the spring 55 best seen in FIG. 13. When the button 62 is depressed by a user, the housing 45 can be moved back to the flange 63.

What is claimed is:

1. An elongated flexible electric conductor of unitary construction having a longitudinal direction of extension, said conductor comprising:

a pair of generally parallel coextensive electrically conductive strips extending in said longitudinal direction; and a resilient support urging the strips into contact, said support being resiliently deformable upon transverse relative displacement of the strips when an item to electrically contact the strips is placed therebetween, said support including a plurality of generally "U" shaped ribs extending transversely of said strips at longitudinally spaced locations along the conductor and providing arms, each rib having a respective one of its arms attached to an associated one of the strips such that a plurality of said arms of said ribs are attached to each strip at spaced locations therealong and wherein the strips have abutting surfaces which are parted by said item being located therebetween.

2. The conductor of claim 1, wherein the strips have generally planar contact surfaces which engage one another when not contacting said items.

3. The conductor of claim 2, wherein the arms of each rib are attached by an arcuate base, with each rib further having arcuate portions joining each arm to its associated strip.

* * * * *